US008175740B2

(12) United States Patent
Lamprillo

(10) Patent No.: US 8,175,740 B2
(45) Date of Patent: May 8, 2012

(54) YARN TENSION MONITORING AND SETTING SYSTEM

(75) Inventor: Stefano Lamprillo, Biella (IT)

(73) Assignee: IRO AB, Ulricehamn (SE)

( * ) Notice: Subject to any disclaimer, the term of this patent is extended or adjusted under 35 U.S.C. 154(b) by 1088 days.

(21) Appl. No.: 12/070,540

(22) Filed: Feb. 19, 2008

(65) Prior Publication Data

US 2008/0210800 A1 Sep. 4, 2008

(30) Foreign Application Priority Data

Feb. 20, 2007 (SE) ..... 0700473

(51) Int. Cl.
*G06F 19/00* (2011.01)

(52) U.S. Cl. ..... 700/130

(58) Field of Classification Search ..... 700/122, 700/126, 130, 139, 140, 143, 144, 142
See application file for complete search history.

(56) References Cited

U.S. PATENT DOCUMENTS

| | | | | |
|---|---|---|---|---|
| 4,778,118 | A | 10/1988 | Niederer | |
| 4,976,018 | A * | 12/1990 | Bollen | 28/187 |
| 5,012,564 | A * | 5/1991 | Gironi et al. | 28/193 |
| 5,136,763 | A | 8/1992 | Nugent | |
| 5,238,202 | A * | 8/1993 | Sheehan et al. | 242/150 M |
| 5,263,244 | A | 11/1993 | Centa et al. | |
| 5,329,822 | A * | 7/1994 | Hartel et al. | 73/862.61 |
| 5,390,670 | A | 2/1995 | Centa et al. | |
| 5,499,772 | A * | 3/1996 | Maeda et al. | 242/417.2 |
| 5,566,574 | A * | 10/1996 | Tiziano | 73/862.473 |
| 5,738,295 | A * | 4/1998 | Flamm et al. | 242/419.1 |
| 5,838,570 | A * | 11/1998 | Barea | 700/143 |
| 5,928,579 | A | 7/1999 | Spahlinger et al. | |
| 6,095,449 | A * | 8/2000 | Gallo et al. | 242/365.4 |
| 6,340,128 | B1 * | 1/2002 | Flamm et al. | 242/413.5 |
| 6,511,011 | B2 * | 1/2003 | Zeller et al. | 242/419.1 |
| 6,691,744 | B1 * | 2/2004 | Birger | 139/450 |
| 6,705,007 | B1 | 3/2004 | Kurita et al. | |
| 6,867,496 | B1 | 3/2005 | Hashimoto | |
| 6,958,614 | B2 | 10/2005 | Morimoto | |
| 7,009,293 | B2 | 3/2006 | Hashimoto | |
| 7,077,168 | B2 * | 7/2006 | Herrlein et al. | 139/194 |
| 7,213,334 | B2 | 5/2007 | Kurita et al. | |

(Continued)

FOREIGN PATENT DOCUMENTS

CN 1078374 A 11/1993

(Continued)

OTHER PUBLICATIONS

First Office Action of China Patent Office dated Apr. 15, 2011 in English (3 pages) including Text of the Notification of the First Office Action in English (3 pages) including Relevant Provisions in English (2 pages).

(Continued)

*Primary Examiner* — Danny Worrell
(74) *Attorney, Agent, or Firm* — Flynn, Thiel, Boutell & Tanis, P.C.

(57) ABSTRACT

Yarn processing system for simultaneously processing a plurality of yarns in a processing machine, such as a twisting machine, a texturizing machine, or a dyeing machine. A yarn tensioning assembly is provided and has, for each yarn entering the processing machine, at least an individual controlled tensioner and an individual tensiometer. The controlled tensioner and the tensiometer are integrated into a closed yarn tension feedback regulation loop for regulating and maintaining a set yarn tension. The tensiometer is connected in parallel to one superimposed common tension monitoring and setting system for centrally setting and monitoring the yarn tension.

14 Claims, 1 Drawing Sheet

U.S. PATENT DOCUMENTS

| | | | | |
|---|---|---|---|---|
| 7,213,925 | B2 | 5/2007 | Fujimori et al. | |
| 7,231,833 | B2 | 6/2007 | McAllister et al. | |
| 7,238,891 | B2 | 7/2007 | Muenzberg | |
| 7,360,441 | B2 | 4/2008 | McAllister et al. | |
| 7,398,587 | B2 | 7/2008 | Morimoto | |
| 7,574,927 | B2 * | 8/2009 | Lamprillo | 73/862.41 |
| 7,584,014 | B2 * | 9/2009 | Gotti et al. | 700/140 |
| 7,770,271 | B2 * | 8/2010 | Kleiner et al. | 28/190 |
| 2001/0028621 | A1 | 10/2001 | Moriyama | |
| 2003/0060062 | A1 | 3/2003 | Honda et al. | |
| 2003/0222660 | A1 | 12/2003 | Morimoto | |
| 2004/0131765 | A1 | 7/2004 | Kurita et al. | |
| 2004/0197102 | A1 | 10/2004 | McAllister et al. | |
| 2005/0040510 | A1 | 2/2005 | Hashimoto | |
| 2005/0057266 | A1 | 3/2005 | Morimoto | |
| 2005/0185146 | A1 | 8/2005 | Fujimori et al. | |
| 2006/0007641 | A1 | 1/2006 | Muenzberg | |
| 2007/0163358 | A1 | 7/2007 | McAllister et al. | |
| 2008/0250872 | A1 | 10/2008 | Lamprillo | |

FOREIGN PATENT DOCUMENTS

| | | | |
|---|---|---|---|
| CN | 1264271 | A | 8/2000 |
| CN | 1281020 | A | 1/2001 |
| CN | 1308322 | A | 8/2001 |
| CN | 1339243 | A | 3/2002 |
| CN | 1375585 | A | 10/2002 |
| CN | 1411327 | A | 4/2003 |
| CN | 1461943 | A | 12/2003 |
| CN | 1658063 | A | 8/2005 |
| CN | 1729732 | A | 2/2006 |
| CN | 1799300 | A | 7/2006 |
| CN | 1871385 | A | 11/2006 |
| EP | 0 644 957 | | 3/1995 |
| EP | 1 223 138 | A2 | 7/2002 |
| JP | 10-310329 | | 11/1998 |
| NL | 1022975 | | 9/2004 |
| WO | WO 03/091136 | A2 | 11/2003 |
| WO | WO 2005/040470 | A1 | 5/2005 |
| WO | WO 2006/005518 | A1 | 1/2006 |

OTHER PUBLICATIONS

European Patent Office extended search report in corresponding EP Application No. 08001222.2, dated Dec. 30, 2009 (10 pages). Response dated Jul. 20, 2010 (11 pages).

* cited by examiner

Y1
Y2
Y3
Y4
A
B
C
D
S
T
M
C
1
2
3
4
5
6
7
8
9
10
11
12
13
14
15
16
17
18
18'
19
20
21
22
23
24 (a-d)
25
26
28
29
30
31
32
33

YARN TENSION MONITORING AND SETTING SYSTEM

FIELD OF THE INVENTION

The invention relates to a yarn processing system for simultaneously processing a plurality of yarns in respective yarn channels of a processing machine, which system includes a yarn tensioning assembly for generating and maintaining a predetermined yarn tension.

EP 0 644 957 A, NL 10 22 975 A, U.S. Pat. No. 4,778,118 and JP-A-10310329 relate to yarn processing systems using a common conveying assembly and a common yarn tensioning assembly for a plurality of yarns which run simultaneously. The respective processing machine is a twisting machine or a texturising machine (air jet entanglement machine), or a spinning machine. JP-A-10310329 discloses individual yarn detectors e.g. for signalling a yarn breakage, and a common signal evaluation device. The common conveying assembly and yarn tensioning assembly has to assure a quite uniform yarn tension among the simultaneously processed yarns. The yarn tension cannot be adjusted individually for each yarn. However, unavoidably, yarn tension variations occur among the yarn, which markedly may have an undesirable influence on the final product quality. Additionally needed individual yarn detectors mean relatively high additional costs. Adjustment to the yarn tension often has to be carried out manually and cannot be done very precisely. The set-up time for a change of a yarn type is undesirably long. The yarn tension cannot be maintained sufficiently uniform over time.

In weaving systems it is known to provide an individual feeding device, an individual controlled tensioner, and an individual tensiometer for each weft yarn. However, the yarns are either processed intermittently and/or one by one, meaning that the yarn tension has to be set for each yarn channel to obtain an individual tension profile for each insertion.

It is an object of the invention to provide a yarn processing system of the type as disclosed at the beginning which assures a very uniform yarn tension in all the yarns which simultaneously enter the processing machine and which avoids additional yarn breakage detectors for the yarns.

BACKGROUND OF THE INVENTION

This object is achieved by providing, for each yarn entering the processing machine, at least an individual controlled tensioner and an individual tensiometer. At least the controlled tensioner and the tensiometer for a respective yarn are integrated into a closed yarn tension feedback regulation loop for regulating and maintaining a set yarn tension, and at least the tensiometer is connected in parallel to at least one superimposed common tension monitoring and setting system for centrally setting and monitoring the yarn tension in each yarn.

According to the invention the yarn tension in each yarn is individually measured and adjusted with a view to the yarn tension in the other yarns such that a very uniform yarn tension is assured for all the yarns simultaneously entering the processing machine. Each tensiometer also functions as a yarn breakage detector so that no additional yarn detectors are needed. The system automatically takes care of adjusting and maintaining the desired tension. Each individual controlled yarn tensioner in the closed regulation loop adjusts the yarn tension guided by the tensiometer such that finally the downstream tensiometer measures the correct yarn tension and can inform the superimposed common tension monitoring and setting system accordingly. The yarn tension for the plurality of yarns is kept exactly at the desired value or within a predetermined range. Alternatively, the yarn tension over time may be maintained within a predetermined relation to other yarns belonging to a yarn group of essentially equal yarns. The system may allow that a detected difference between the highest and lowest yarn tensions among the yarns in the yarn group does not exceed a certain percentage. The closed feedback regulation looping co-action with the tension monitoring and setting system allows maintaining the desired very precise yarn tension over time. The individual conveyors of the plurality of yarns, expediently, are operating synchronously. In the closed yarn tension feedback regulation loop of each yarn the set absolute or average value of the yarn tension is the guiding parameter of the regulation carried out by the co-operation between the tensiometer and the controlled tensioner. The regulation loop is closed by the yarn itself. Any occurring out of value or out of range condition is registered by the common tension monitoring and setting system and can be used to immediately stop the yarn processing system or initiate another action.

Expediently, each regulation loop or a regulator in the respective closed regulation loop is connected to an input of an interface assembly, which either is connected to or is integrated into the tension monitoring and setting system. The communication between the interface assembly and the closed regulation loops is bi-directional as is the communication between the interface assembly and the tension monitoring and setting system. The regulator of each closed regulation loop e.g. could be integrated into the interface assembly, or the interface assembly could be integrated into the tension monitoring and setting system.

Preferably, the interface assembly has a series of discrete input ports serving as connection terminals for the closed regulation loops, while a single output/input port could be used for the communication between the interface assembly and the tension monitoring and setting system.

In an expedient embodiment a regulator is contained in each closed regulation loop. The regulator may include at least one signal evaluation circuitry. Instead of placing the regulator in the regulation loop, the regulator could be placed in the interface assembly. The evaluation circuitry serves to evaluate the measured value of the yarn tension output by the tensiometer and to control the activation intensity of the controlled yarn tensioner accordingly. The regulator then adjusts the activation intensity for the controlled yarn tensioner depending on the actually measured value of the yarn tension. The conveyor placed upstream of the controlled yarn tensioner already may even out yarn tension fluctuations at the upstream side, e.g. resulting from a varying yarn bobbin diameter, spooling irregularities of the yarn on the storage bobbin, etc. This means that the conveyor already presents the yarn for the further processing by the yarn tensioner with a relatively uniform basic yarn tension facilitating the work for the controlled yarn tensioner to adjust precisely the needed yarn tension by guidance from the tensiometer.

In a preferred embodiment the conveyor is a positive or non-positive yarn feeding device. Such yarn feeding devices (normally implemented in weaving or knitting appliances) fulfill a very important yarn tension smoothing task in a yarn processing system, which simultaneously processes a plurality of running yarns.

In an expedient embodiment, the yarn feeding devices implemented as the individual conveyors are yarn feeding devices, which are normally used in rapier or projectile weaving machines. The stationary storage drum of the yarn feeding device carries several yarn windings consecutively formed by the winding element and present the yarn for further withdrawal with a relatively constant and predetermined basic yarn tension when it is withdrawn via the controlled tensioner into the processing machine. The driven winding element in co-action with the electronic speed control does not only even out yarn tension variations at the upstream side of the yarn path but also prepare a just sufficiently large yarn store on the stationary storage drum to cope with the consumption in the processing machine.

The electronic speed control of the yarn feeding device may be connected to the closed regulation loop, e.g. for an advantageous co-operation with the downstream controlled yarn tensioner and the tensiometer and as well with the interface assembly and/or the tensioning monitoring and setting system.

In another (not shown) alternative embodiment, the individual conveyors are excluded from the yarn processing system, which could be achievable in applications where a sufficient continuous input yarn tension to the respective controlled tensioner and tensiometer combination is maintained by drawing or feeding the yarn directly from the yarn stores, e.g. the yarn bobbins.

Expediently, the controlled tensioner is an electronically controlled yarn tensioner, e.g. actuated by a step motor or a permanent magnet motor. A deflection tensioner varies the deflection of the yarn while it runs through. A clamping tensioner varies the clamping force imparted on the yarn while the yarn is running through a tensioning zone of the clamping tensioner. Expediently, the clamping tensioner may be a TEC-tensioner available from the applicant. An electronically controlled yarn tensioner assures short response time, precise variations of the tensioning effect, low power consumption and high reliability.

Expediently, the controlled yarn tensioner is mounted to the exit side of the yarn feeding device. This avoids additional deflection points in the yarn path and allows controlling the yarn tension where the yarn is leaving the yarn feeding device.

Expediently, the tensiometer is provided downstream of the controlled tensioner, because it has to survey and control the yarn tension as adjusted by the controlled yarn tensioner. Preferably, the tensiometer even may be integrated into the controlled tensioner, such that additional deflection points in the yarn path as needed for the action of the tensiometer are avoided.

Expediently, the tension monitoring and setting system is integrated into the processing machine. A perfect location for the tension monitoring and setting system would be the machine control system. This allows the use of the normally provided indicating and setting section, screens, etc. of the machine control system for the additional task of the tension monitoring and setting system.

Alternatively, the tension monitoring and setting system could be arranged separate from the processing machine. This tension monitoring and setting system then may be constituted exactly for this task only. In this case it might also be expedient to have a communication connection between the separate tension monitoring and setting system and the machine control system.

In an expedient embodiment the tension monitoring and setting system is combined with an expert system. The expert system (e.g. known from patent application WO 2005/040470 A1) may have a collection of previously determined yarn tension settings associated to different yarn qualities and/or different yarn processing machines, e.g. in a table or list. Those previously determined yarn settings then will be available for the tension monitoring and setting system in the initial yarn processing system to more easily set optimum yarn tension values or yarn tension value ranges for all yarns or for yarn groups.

Expediently, the tension monitoring and setting system, particularly in the case that it is separated from the machine control system, may comprise a yarn tension setting/indicating section. This section may not only be used for executing settings of the respective yarn tensions, but also to show or display the actually measured yarn tension over time or the relation between yarn tensions of yarns within a yarn group, and the like. This computerised system also may be used to carry out recordings, e.g. to develop and store trends which result in failure conditions for later facilitating troubleshooting and the like.

At least one monitor should be provided at least for displaying for each yarn or for several at least substantially equal yarns of a yarn group the tension values, the tension value ranges, average tension values or tension profiles over time. The monitor greatly enhances the versatility of the system for operators.

In the tension monitoring and setting system the respective absolute value or a range for the absolute value or an average value of the yarn tension for each yarn or for a yarn group may be set. Of course, settings can be changed through the operation of the yarn processing system, e.g. in the case that the failure quota shows a tendency to increase.

Moreover, the settings may be carried out such that specific boundaries are fixed in the relationship between the yarns which belong to the same yarn group, such that the system during operation will allow fluctuations in the yarn tension between the yarns of the yarn group, but only to a certain extent as defined by limits representing severe failure conditions needing counter actions or a stoppage of the system. A counter action could be issuance of alarm signals. Another possibility would be to slow down the processing speed of the yarn processing system for a while, or to even switch off the system immediately. The program of the system could be intelligent enough to display advice or recommendations for corrections of the settings, e.g. during a waiting phase with reduced yarn processing system operation speed or after a shutdown of the yarn processing system. For this purpose, the tension monitoring and setting system may be connected to an alarm system, a processing system main switch, or a system operation correction assembly, accordingly, either directly or via the machine control system. In the latter case, the tension monitoring and setting system itself may initiate and execute operation correction measures.

Since it is expedient to use fast bi-directional communications among the components of the system or at least among several components of the system it is expedient to use at least one CAN-bus communication line. The CAN system allows achieving sufficiently high communication speed and data transmission rates with high system security and great reliability.

Since, in particular in case of a large number of simultaneously processed yarns, the tensiometers should be reliable but available for fair cost, according to an important embodiment the tensiometer is provided with a flexible element which is fixed at one end and is loaded at the other end by the yarn. The flexible element is a flexible printed circuit, which carries at least one sensor element, e.g. piezo-element or the like, which generates and transmits a signal corresponding or proportional to the load imparted by the yarn (the yarn tension). Finally, the flexible printed circuit should, at least partly, be coated with highly flexible temperature insulating and wear resistant material. This could be a polyimide film like KAPTON, poly(4,4'-oxydiphenylene-pyromellitimide).

This type of coating essentially decreases the temperature influence to the sensor system, a factor that is very well known to the person skilled in the art. The flexibility of the coating is needed to not interfere with the load sensing property of the tensiometer by flexing the flexible element.

BRIEF DESCRIPTION OF THE DRAWINGS

Embodiments of the invention will be described with reference to the drawings in which.

DETAILED DESCRIPTION

Figures 1, 2:
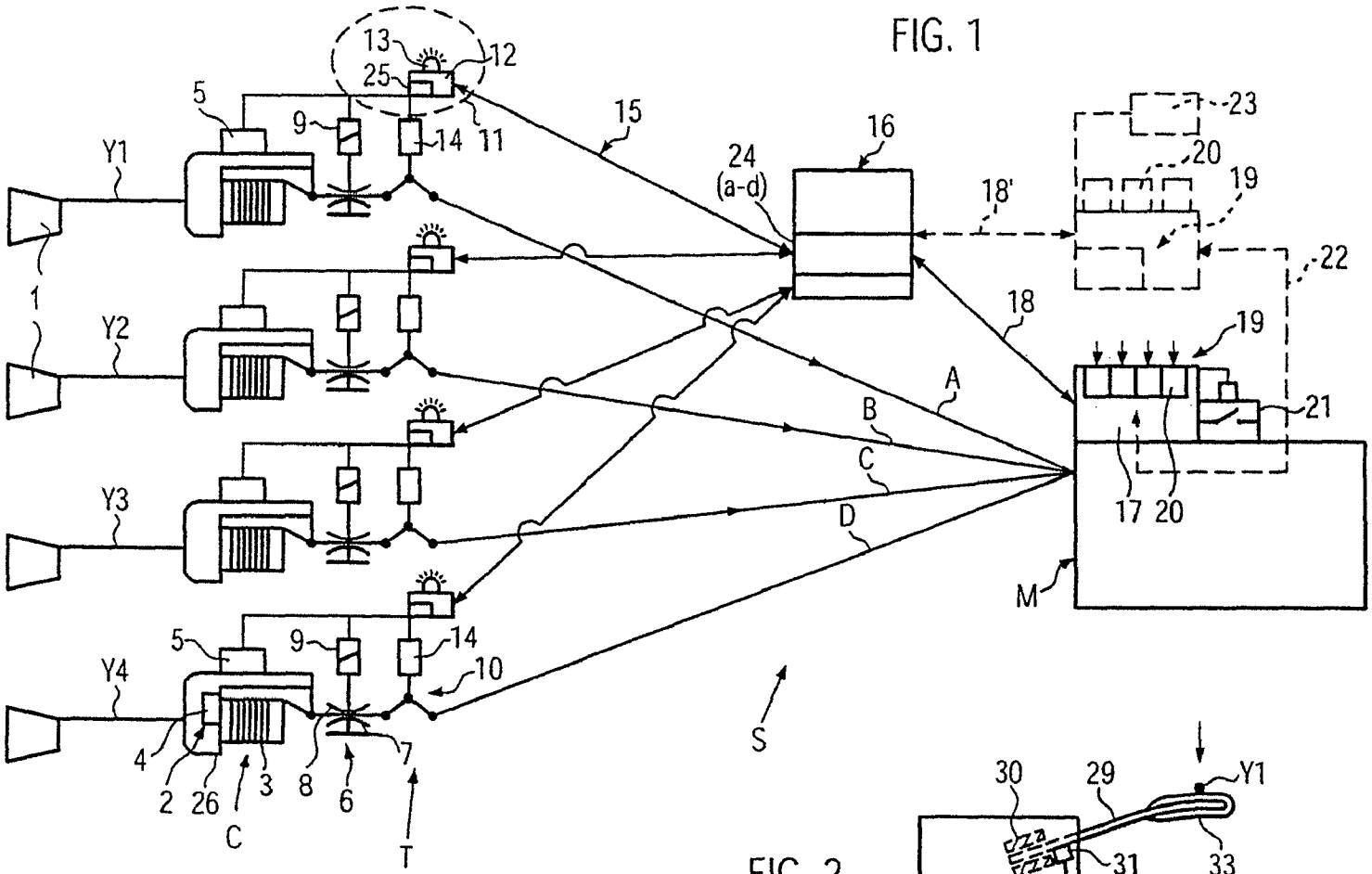
FIG. 1 shows a schematic diagram of a yarn processing system simultaneously processing a plurality of yarns.
FIG. 2 shows a schematic side view of a tensiometer as implemented in the yarn processing system of FIG. 1.

A yarn processing machine M, e.g. a yarn twisting machine, a texturising machine like e.g. an air jet entanglement machine, or a dyeing machine, simultaneously is processing a plurality of yarns Y1 to Y4 (or even many more) which run in separate yarn channels A to D either into a common entrance or in several entrances of the yarn processing machine M. Between e.g. a series of yarn storage bobbins 1 and the yarn processing machine M a yarn conveying assembly C and a yarn tensioning assembly T is arranged. The yarn conveying assembly C is split up in a respective number of conveyors, each for a single yarn Y1 to Y4 only, e.g. yarn feeding devices 2. Each yarn feeding device could be a yarn feeding device normally used for rapier or projectile weaving machines. The respective yarn feeding device 2 has a stationary storage drum 3, an electric motor 4 for driving a winding element 26, and an integrated speed control 5.

Similarly, the yarn tensioning assembly T is split into a respective number of individual and electronically controlled yarn tensioners 6. The respective yarn tensioner 6 is arranged downstream of the yarn feeding device 2, or, alternatively, directly at the exit of the yarn feeding device 2. The controlled yarn tensioner 6 e.g. is of a clamping tensioner type having a stationary tensioning surface 7 and a movable tensioning element 8 for variably clamping the yarn in-between or completing releasing the yarn. The movable clamping element 8 may be actuated by an actuator 9. Instead, a deflective type controlled tensioner could be implemented.

Downstream of the controlled yarn tensioner 6 a tensiometer 10 is arranged, in some cases even integrated into the controlled yarn tensioner 6. The tensiometer 10 has a sensor element 31 (FIG. 2) generating an output signal corresponding or proportional to the yarn tension for measuring the actual value of the yarn tension. The output signal of the sensor element 31 may be evaluated and processed in a component 14 of the tensiometer 10.

At least the controlled tensioner 6 and tensiometer 10 are contained in a closed yarn tension regulation loop 11 for regulating the yarn tension according to a set value or a set value range. A regulator 12 may be provided in the controlled regulation loop 11. Even the speed control 5 of the yarn feeding device 2 may be connected to the closed regulation loop 11. The regulator 12 e.g. may have an alarm device 13 for indicating an alarm condition. Evaluation circuitry 25 may be implemented in the regulator 12.

In the shown yarn processing system S of FIG. 1 the regulator 12 of each closed regulation loop 11 is shown in communication via communication line 15, preferably a bi-directional communication line 15, with an interface assembly 16 commonly provided for all closed regulation loops 11. The interface assembly 16 in turn is connected via a communication line 18 to a yarn tension setting and monitoring system 19 which in FIG. 1 may be integrated into a machine control system 17 of the yarn processing machine M, namely for setting and monitoring the yarn tensions centrally.

In an alternative embodiment, the respective regulator 12 could be implemented into the interface assembly 16, or the interface assembly 16 even could be integrated into the yarn tension setting and monitoring system 19. Preferably, the interface assembly 16 has an input 24 for all communication lines 15, preferably an input 24 with separate input ports a-d which facilitate to discriminate between the information as received or as transmitted.

The yarn tension monitoring and setting system 19 comprises a yarn tension setting and indicating section 20, e.g. including a monitor or screen 27 for displaying absolute or average values of the yarn tension, ranges of the yarn tension, development of the yarn tension over time, and the like. In the case that the yarn tension setting and monitoring system 19 is integrated into the machine control system 17, of course, a communication may take place between the machine control system 17 and the yarn tension setting and monitoring system 19. A device 21 for switching off the entire yarn processing system S, or for temporarily slowing down the operation of the yarn processing system S may be provided, in connection with either the machine control system 17 or the yarn tension setting and monitoring system 19.

In an alternative embodiment (shown in dotted lines in FIG. 1), the yarn tension setting and monitoring system 19 may be arranged separate from the machine control system and may be connected via a communication line 22 with the machine control system 17.

The yarn tension setting and monitoring system 19 could be combined with an expert system 23, which presents previously determined yarn tension settings associated to different yarn qualities and/or different yarn processing machines for being retrieved or obtained by the yarn tension setting and monitoring system 19. The expert system 23 e.g. may be plugged in only temporarily.

Expediently, the communication lines 15, 18, 18' and even 22 like the communication line in each closed yarn tension regulation loop 11 may be CAN-communication lines of a computerised communication CAN-bus system implemented into the yarn processing system.

The respective tensiometer 10 may have, as shown in FIG. 2, a flexible element 29 which is fixed at one end in a fixation 30 of a housing 28, the other end of which is loaded by the respective yarn, like the yarn Y1, to measure the yarn tension in the yarn. The flexible element 29 consists of a flexible printed circuit, which may have a coating 33 of highly flexible temperature and wear resistant material. This coating may be a polyimide film consisting e.g. of KAPTON, poly(4,4'-oxydiphenylene-pyromellitimide). The sensor element 31 is supported by the flexible element 29 so that the sensor element 31 reads the bending of the flexible element 29 and generates an output signal which is corresponding or proportional to the yarn tension and which output signal then may be evaluated e.g. in an evaluation circuitry 32, before it is transmitted to either the regulator 12 or the interface assembly 16.

From the common yarn tension setting and monitoring system 19, desired and set yarn tension values are transmitted to each individual sub-system of the respective yarn channel A to D. Alternatively, several desired yarn tension values could be transmitted to several sub-systems each processing a group of largely similar yarns or yarn qualities the yarn tension of which are compared and controlled in relation to each other.

Each tensiometer at the same time functions as a yarn breakage detector, as it in the case of a yarn breakage signals an out of value or out of range condition with which neither the regulator 12 nor the interface assembly 16 nor the yarn tension setting and monitoring system 19 could cope differently than by switching off the system or at least setting an alarm indication. The system assures a very uniform yarn tension for all yarns or all yarns of the yarn group. The system allows showing the yarn tension profile over time for each yarn, e.g. in the monitor 27.

It is possible to easily set desired yarn tensions or allowable yarn tension fluctuation ranges or relationships between the yarn tensions in the yarns belonging to the same yarn group. The system automatically takes care of the adjustment of the respective yarn tension. The regulation of the respective yarn tension takes place in a closed regulation loop and in a coordinated manner either for all yarns or at least for a yarn group. The tension in each yarn is kept within a predetermined range in its absolute or average value over time or with relation to the tension of the other yarns belonging to the same yarn group. If any of these yarn tensions exceeds the allowed or predetermined range, for example when a yarn is broken, the processing machine will be stopped immediately, or another action is initiated.

The invention claimed is:

1. A yarn processing system for simultaneously processing a plurality of yarns, said system comprising:

a yarn processing machine configured for one of twisting, texturizing and dyeing each yarn of the plurality of yarns, said yarn processing machine defining respective yarn channels for each yarn of the plurality of yarns and including a machine control system;

a plurality of rapier or projectile yarn feeding devices each configured for use with a rapier or a projectile weaving machine, each said yarn feeding device including a stationary storage drum, a rotatably-driven winding element and an electronic speed control, each said yarn feeding device corresponding to one yarn of the plurality of yarns entering said yarn processing machine;

a yarn tensioning assembly for generating and maintaining a predetermined yarn tension, said yarn tensioning assembly including a plurality of closed yarn tension feedback regulation loops each corresponding to one yarn of the plurality of yarns entering said yarn processing machine, each said loop including one of said electronic speed controls, an individually controlled tensioner, an individual tensiometer and a regulator for regulating and maintaining a set yarn tension in each yarn; and a tension monitoring and setting system common for all of said yarn feeding devices for centrally setting and monitoring the yarn tension in each yarn, said tensiometers being connected in parallel to said tension monitoring and setting system.

2. The yarn processing system of claim 1, further including an interface assembly connected to or integrated into said tension monitoring and setting system, and each said regulator comprises signal evaluation circuitry and is connected to an input of said interface assembly.

3. The yarn processing system of claim 1, wherein each said tensioner comprises an electronically controlled deflection tensioner or a clamping tensioner, said tensioner being mounted to an exit side of the respective said yarn feeding device.

4. The yarn processing system of claim 1, wherein each said tensiometer is disposed, with respect to a yarn movement direction, downstream of the respective said tensioner.

5. The yarn processing system of claim 1, wherein said tension monitoring and setting system is integrated into said machine control system or arranged separate from said yarn processing machine and connected to said machine control system.

6. The yarn processing system of claim 1, wherein said tension monitoring and setting system is combined with an expert system in which previously determined yarn tension settings are stored ready for said tension monitoring and setting system.

7. The yarn processing system of claim 1, wherein said tension monitoring and setting system includes a yarn tensioner setting and indicating section, a monitor for displaying tension information for each yarn or for a yarn group of several substantially equal yarns.

8. The yarn processing system of claim 1, wherein said tension monitoring and setting system is configured to set a predetermined range for an absolute value or an average value over a selectable period of time for each yarn or for a yarn group of several substantially equal yarns.

9. The yarn processing system of claim 8, wherein the range or value is set for each yarn in relation to the range or value set for other yarns in the yarn group of substantially the same yarn quality, and said tension monitoring and setting system includes a program for an alarm, a system operation correction or a switch-off action which is actuated when either an out-of-range or an out-of value condition for a single yarn or a predetermined deviation in relation to other yarns of the yarn group is detected.

10. The yarn processing system of claim 1, wherein said tension monitoring and setting system is connected either directly or via said machine control system by an actuation line to an alarm system, a system main switch or a system operation correction assembly.

11. The yarn processing system of claim 1, wherein said yarn tensioning assembly and said tension monitoring and setting system are connected to said machine control system by at least one CAN-bus communication line.

12. A yarn processing system for simultaneously processing a plurality of yarns in respective yarn channels of a processing machine for twisting, texturizing or dyeing the yarns, said system comprising a yarn tensioning assembly for generating and maintaining a predetermined yarn tension, wherein for each yarn entering said processing machine at least an individual controlled tensioner and an individual tensiometer are provided, said tensioner and said tensiometer for a respective yarn are integrated into a closed yarn tension feedback regulation loop for regulating and maintaining a set yarn tension, and at least said tensiometer is connected in parallel to at least one superimposed common tension monitoring and setting system for centrally setting and monitoring the yarn tension in each yarn, said tensiometer including a flexible element comprising a flexible printed circuit, said printed circuit being fixed at one end and loaded at an opposite end by the yarn, said flexible element carrying at least one sensor element and being partly coated with highly flexible temperature and wear resistant material.

13. The yarn processing system of claim 12, wherein said wear resistant material comprises a polyimide film.

14. The yarn processing system of claim 13, wherein said film comprises poly(4,4'-oxydiphenylene-pyromellitimide).

* * * * *